US009441176B2

(12) United States Patent
Moniotte et al.

(10) Patent No.: US 9,441,176 B2
(45) Date of Patent: Sep. 13, 2016

(54) PROCESS FOR REMOVING SILOXANE-BASED DERIVATIVES FROM A LIQUID ORGANIC PHASE

(75) Inventors: Philippe Gerard Moniotte, Heron (BE); Pierre-Francois Etienne Rose-Marie Bareel, Uccle (BE); Francois Jean Emilien Pierre Collignon, Genappe (BE); Philippe Alfred Grosjean, Montigny-le-tilleul (BE)

(73) Assignee: SA COMET TRAITEMENTS, Chatelet (BE)

( * ) Notice: Subject to any disclaimer, the term of this patent is extended or adjusted under 35 U.S.C. 154(b) by 673 days.

(21) Appl. No.: 13/989,022

(22) PCT Filed: Nov. 22, 2011

(86) PCT No.: PCT/EP2011/070672
§ 371 (c)(1),
(2), (4) Date: May 22, 2013

(87) PCT Pub. No.: WO2012/069467
PCT Pub. Date: May 31, 2012

(65) Prior Publication Data

US 2013/0232857 A1 Sep. 12, 2013

(30) Foreign Application Priority Data

Nov. 22, 2010 (BE) ..... 2010/0697

(51) Int. Cl.
*C10L 8/00* (2006.01)
*C10G 19/00* (2006.01)
*C10G 19/02* (2006.01)

(52) U.S. Cl.
CPC ..... *C10L 8/00* (2013.01); *C10G 19/00* (2013.01); *C10G 19/02* (2013.01); *C10G 2300/4006* (2013.01)

(58) Field of Classification Search
CPC ..... C02F 19/00
See application file for complete search history.

(56) References Cited

U.S. PATENT DOCUMENTS 5,166,384 A 11/1992 Bailey et al.
6,284,859 B1 9/2001 Hupfield et al.

FOREIGN PATENT DOCUMENTS

DE 10008247 9/2001
EP 2149593 2/2010

OTHER PUBLICATIONS

European Patent Office International Search Report and Written Opinion dated Dec. 28, 2011, for International Patent Application No. PCT/EP2011/070672, Applicant, Philippe Moniotte (6 pages).
Dewil, R. et al., "Energy use of biogas hampered by the presence of siloxanes", Energy Conversion and Management, Nov. 21, 2005, vol. 47, pp. 1711-1722 (retrieved on Aug. 1, 2006) (12 pages).

*Primary Examiner* — Peter Keyworth
(74) *Attorney, Agent, or Firm* — Koppel, Patrick, Heybl & Philpott

(57) ABSTRACT

A method for mineralizing siloxane derivatives from a liquid organic phase by adding a base in the form of an alkaline hydroxide.

14 Claims, No Drawings

PROCESS FOR REMOVING SILOXANE-BASED DERIVATIVES FROM A LIQUID ORGANIC PHASE

The present invention relates to a method for removing derivatives based on siloxane from at least one liquid organic phase, comprising the following steps:

- heating said liquid organic phase to a predetermined temperature,
- adding a base to said heated organic phase in order to obtain a reaction mixture,
- mineralization of the compounds based on siloxane in said organic phase, and
- a liquid/solid separation of said mineralized solid compound based on siloxane from said liquid organic phase depleted in siloxanes.

Methods are known with which it is possible to carry out catalytic cracking of solid waste in order to obtain finally a product in liquid or oily form from this catalytic cracking, generally called a cracking residue or pyrolytic oil.

Solid wastes based on plastic material are increasingly present and this for many years. These solid wastes based on plastic material mainly stem from the recovery of metals from automobiles, domestic appliances and other consumer products which are contaminated by organic by-products such as plastic materials, rubbers, coatings and sealants, textiles and expensed materials.

These solid organic by-products therefore form the solid waste based on plastic material. Hosts of clever methods have been developed for recycling them in another plastic material, but the yields remain very low and finally the solid wastes based on classic material have most often been dumped for many reasons such as heterogeneity of their composition, contamination by other residues, dust, earth, oils, etc.

A known alternative for these solid wastes based on plastic material which are difficult to recycle, consists of recovering them in order to produce energy such as for example, making fuels from these solid wastes, which at least partly allows recovery of their energy value. These solid wastes based on plastic material comprise thermoplastics, thermosetting plastics, elastomers, textile, wood, such as for example polyethylene (PE), polypropylene (PP), polystyrene (PS), polyethylene terephthalate (PET) as well as often polyvinyl chloride (PVC). These solid wastes may be either introduced into a catalytic cracking reactor or not at the same time as a catalyst, for example based on zeolites, which at high temperature allows promotion of the decomposition of the plastic materials. Of course, these solid wastes do not only contain carbonaceous material but also contain impurities, such as for example chlorine, bromine, silicon, fluorine and sulfur. Accordingly, catalytic cracking of these plastic materials has greatly focused on the removal of the contaminating compounds which are mainly found with the formed volatile organic compounds in order to avoid their discharge into the atmosphere and the catalytic cracking methods have greatly evolved over time.

Typically, the volatile fraction from catalytic cracking of solid wastes based on plastic material stemming from automobile wastes, contains up to several thousands of ppm of silicon, sulfur, chlorine as well as several hundreds of ppm of bromine and of fluorine. This volatile fraction is the one which is used for obtaining combustible materials (or fuels) and the presence of these elements in residues causes fouling, corrosion, abrasion and various failures in engines when they are used as a combustible material or a fuel.

Accordingly, catalytic cracking methods are now often accompanied by steps for stripping, condensing, removing various contaminants and the like.

However, at the present time, the volatile fraction of catalytic cracking residues always contains compounds based on silicon, which are particularly detrimental because their combustion in engines leads to the formation of silicon oxides which are highly abrasive residues.

U.S. Pat. No. 5,166,384 describes a method for removing siliceous compounds dissolved in a hydrocarbon, which comprises a heating step with stirring and a step for adding an oxygenated boron-containing compound, for example boric acid, which causes precipitation of the siloxanes from the solvent, the latter being finally separated from the solvent by filtration. Mention is also made of the addition of sodium methoxide or potassium methoxide for increasing the precipitation rate of siloxanes. This technique for removing siloxanes present in a solvent is therefore based on the addition of an oxygenated boron-containing compound and of a methoxide. However, in the case of the treatment of cracking residues, addition of an acid would be unsuitable since it would cause polymerisation of the olefins stemming from cracking residues while the latter have precisely been cracked earlier. Further, the addition of methoxide is a very costly step since the latter is required in a large amount and is accompanied by the addition of a halogenated acid, which makes its industrial utilization a problem (cost and pollution).

Moreover, from the state of the art, the removal of silicon derivatives present in a gas phase is known either by condensation and adsorption on coal and active graphite or by bubbling in diesel fuel or an absorbing organic phase, which has the result of contaminating the diesel phase with siloxane, of providing a gas phase free of silicon derivatives. Surprisingly, it has been shown by analysis with mass spectroscopy coupled with chromatographic analysis that the major portion, if not the entirety of the volatile compounds containing silicon compounds in the cracking residue, is in the form of an oligomeric polydimethylsiloxane (PMDS), probably stemming from the presence of a rubber, a gasket, a sealant and a coating which contaminate the plastic materials to be recovered.

To solve this problem, the present invention provides a method for removing derivatives based on siloxane from at least one liquid organic phase, in particular, in catalytic cracking residues of solid wastes based on plastic material as indicated in the beginning, characterized in that said base is in the form of an alkaline hydroxide and in that the heating step is carried out at said predetermined temperature which is greater than 165° C.

In this way, compounds based on siloxane are precipitated under the effect of the base and of the heating and the liquid/solid separation such as a distillation allows recovery of an organic mixture which then may be used in a safe way in an internal combustion engine. Even more surprisingly, it was observed according to the invention that the concentration of halogenated compounds (with bromine, chlorine, fluorine . . . ) in the distillate is also greatly reduced as compared with the cracking residue.

Further, it is advantageous to operate at this predetermined temperature above 165° C. which allows the use of the hydroxide in a liquid or solid form since the latter will pass to the molten state in the organic phase. Preferably, this pre-determined temperature is less than 450° C., or even less than 400° C. in order to avoid cracking the compounds of the liquid organic phase.

Advantageously, after said addition of the base in the form of an alkaline hydroxide, the reaction mixture is left to react for a predetermined period of time at said predetermined temperature, preferably with stirring.

In a particular embodiment of the method according to the invention, said pre-determined temperature is comprised between 200 and 350° C., preferably between 200 and 250° C., which represents an optimum between pressure and temperature which should prevail in the reactor in order to maintain the base in the dissolved or dispersed state in the latter with a dwelling time as short as possible. Beyond 300° C., the pressure should be greater than 20 bars and would require highly performing materials, resistant to very high constraints which would increase the costs of these devices. As an example, at a temperature of 300° C., the pressure should be ideally comprised between 15 and 20 bars, which already represents a high constraint for the equipment used.

Advantageously, said predetermined period of time is comprised between 1 and 250 minutes, preferably between 1 and 45 minutes, depending on the composition of the liquid organic phase. Indeed, in a first phase, if they are present, the acids are neutralized and the corresponding salts are formed and then mineralization reactions occur, giving the possibility of removing siliceous derivatives in the form of solid derivatives. Said period of time, although very short, will depend on the content of acid derivatives (if they are present) and of siliceous derivatives.

Preferably, the added base is selected from KOH and NaOH. These basic compounds have actually shown particular efficiency for mineralizing compounds based on siloxane at said predetermined temperature in a liquid organic phase.

According to the invention, the method advantageously comprises prior to said mineralization of the compounds based on siloxane, a separation of phenol derivatives and of acids, for example carboxylic acids.

Actually, the addition of the base allows neutralization of the phenol derivatives and of the acids, for example carboxylic acids, possibly present in the volatile fraction of the residue from catalytic cracking, which initially consumes the base. There is therefore a benefit in separating these compounds before mineralization of the compounds based on siloxane since the latter may have usefulness as such in the liquid form.

Advantageously, according to the invention, said liquid/solid separation is a distillation which is carded out under reduced pressure, preferably comprised between 1 and 300 mbars until the column head fraction attains a temperature above 200° C., for example 250° C.

In an embodiment according to the invention, the method may comprise, after said mineralization step, a filtration step in order to carry out solid/liquid separation with view to recovering the solid mineralized silicon derivative.

According to the invention, the liquid organic phase may be a catalytic cracking residue of solid wastes based on plastic materials comprising thermosetting, thermoplastic, elastomeric plastic materials, textile materials and wood.

In an alternative according to the invention, the liquid organic phase is obtained by bubbling of a gas phase containing derivatives based on siloxane in a diesel fuel or an absorbing organic phase, consequently allowing provision of a solution for lowering the derivatives based on siloxane transferred into the absorbing liquid organic phase or into the diesel fuel and finally allowing treatment of the latter.

More particularly, according to the invention, said heating step is carded out as quickly as possible in order to obtain the predetermined temperature, in order to obtain optimum yield.

Other embodiments of the method according to the invention are indicated in the appended claims.

Other features, details and advantages of the invention will become apparent from a description given hereafter, in a non limiting way and with reference to the appended example.

The present invention therefore describes a method with which derivatives based on siloxane may be removed from an organic phase, in particular in catalytic cracking residues of solid wastes based on plastic material. This liquid organic phase may stem from a catalytic cracking method for residues from the milling of thermoplastic, thermosetting, elastomeric, textile and wood materials.

Typically, these waste milled residues are of two types, lightweight residues and heavy residues. Generally, milling residues which are difficult to recycle are present on the market as a mixture in proportions of 65% of lightweight milled residues and of 35% of heavy milled residues.

Their average composition is shown in Table 1.

TABLE 1

| | Lightweight milled residues (%) | Heavy milled residues (%) |
|---|---|---|
| Rubbers | 6.7 | 36.4 |
| Plastics (including PVC, PC, PET, PMMA, PA et ABS, . . .) | 29.1 | 52.2 |
| Metal | 2.9 | 0.9 |
| Wood | 19.3 | 9.1 |
| Foam + fabric | 28.5 | 1.3 |
| Wastes/stones | 15.8 | 0.1 |

Characterization of both types of milled residues was completed by an elementary analysis shown in Table 2.

TABLE 2

| | Lightweight milled residues | Heavy milled residues |
|---|---|---|
| Humidity | 2.2 | 6.3 |
| Sulfur content (%) | 0.09 | 0.25 |
| Chlorine content (%) | 1.0 | 7.1 |
| Bromine content (ppm) | 550 | 17000 |
| Fluorine content | 92 | 170 |
| Carbon content (%) | 83.6 | 53.9 |
| Hydrogen content (%) | 7.6 | 5.9 |
| Nitrogen content (%) | 1.7 | 1.7 |
| Oxygen content (%) | 27.1 | 16.4 |

Moreover it is seen that the halide content (Cl+Br+F) is higher in the heavy milled residue than in the lightweight residue, this is particularly pronounced for the chlorine element.

The milled residues are then catalytically cracked in a high temperature fluidized reactor according to a conventional method and a liquid organic phase (the volatile fraction is recovered). Within the scope of the present invention, said organic phase is heated as quickly as possible to the predetermined temperature comprised between 150 and 300° C., preferably between 200 and 250° C.

Alternatively, the liquid organic phase is the result of bubbling of a volatile gas phase containing derivatives based on siloxane in diesel fuel or in an absorbing organic phase in order to transfer therein the derivatives based on siloxane and optionally proceed with partial heating or pre-heating of the liquid organic phase. According to the invention, the liquid organic phase may also be a mixture of a residual liquid organic phase from catalytic cracking and of an organic phase enriched in siloxane by bubbling of a gas phase. Moreover, the bubbling may be also carried out during the heating and in the residual liquid organic phase from catalytic cracking.

A base selected from KOH and NaOH is then added in order to obtain a reaction mixture and the latter is left to react for a predetermined period of time comprised between 1 and 250 minutes, preferably between 1 and 45 minutes, with stirring. During the reaction, the compounds based on siloxane in said organic phase are mineralized as well as a large portion of the halogens when they are present, by the action of the base. The halogens, when they are present, are mineralized by the reaction of organic molecule(s) which contain them with the base. The present base also allows when they are present, the neutralization of phenol derivatives and of acids, for example carboxylic acids and this prior to the mineralization since the neutralization will occur first. The adds may also be halogenated adds which will then be neutralized by the base.

The method further comprises in this preferential embodiment, distillation of said reaction mixture in order to separate said mineralized compounds based on siloxane from said organic phase free of any compound based on silicon and said distillation is preferably carried out under reduced pressure, preferably from 1 to 300 mbars until the column head fraction attains a temperature of at least 200° C., preferably 250° C.

The compound based on mineralized silicon is an insoluble compound in the liquid organic phase and is therefore in the form of a very thin mud, particularly difficult to filter. For this reason, the obtained compound based on silicon is therefore removed in this particular embodiment by distillation, which further gives the possibility and in an advantageous way, of reducing the concentration at the end of the distillation, of halogenated compounds.

EXAMPLE 1

In a stirred autoclave of 600 ml, 250 ml of a liquid cracking residue obtained from pyrolysis of wastes from the recycling of automobile vehicles are placed. The tank of the autoclave was equipped with a stirrer, with pressure and temperature probes and with an electric heating system.

8 g of sodium hydroxide were added in the form of granules and the autoclave was closed. The tank was then heated as quickly as possible up to 225° C., with efficient stirring. The maximum temperature was maintained for 30 minutes. The autoclave was then left to cool down and after ventilation, the contents of the tank of the autoclave was transferred to a glass distillation apparatus and the later was distilled under reduced pressure of 50 mm Hg, until the head of the column attains 200° C.

A sample of the obtained distillate was taken and was subject to elementary analysis for detecting the presence of silicon (by ICP), of chlorine and of bromine (ion exchange chromatography after mineralization).

Table 3 shows the comparison of the composition obtained after distillation relatively to the liquid residue from catalytic cracking of a solid waste based on plastic material.

TABLE 3

| | Si (ppm) | Cl (ppm) | Br (ppm) |
|---|---|---|---|
| Before the method according to the invention | 548 | 3 422 | 100 |
| After the method according to the invention | <1 | 817 | <50 |

EXAMPLE 2

In a stirred autoclave of 600 ml, 450 ml of a liquid cracking residue were placed, obtained from pyrolysis of waste stemming from the recycling of automobile vehicles. The tank of the Parr autoclave was equipped with a stirrer, with pressure and temperature probes and an electric heating system.

The autoclave was dosed and was heated up to 205° C. 30 g of a solution of sodium hydroxide (at 50% by weight) was added by injecting it under pressure for 20 seconds into the autoclave. Samples (of approximately 5 g) of the reaction mixture were drawn off from the autoclave after 5, 15 and 30 minutes at constant temperature.

The samples were analysed by gas chromatography/mass spectrometry in the SIM (Single Ion Monitoring) mode in order to detect the presence of 6 arbitrarily selected oligomers of dimethylsiloxane, potentially present in the original cracking product resulting from the pyrolysis operation.

Calibration was carried out by external standardization (the values below 1 ppm are considered as being below the sensitivity/reliability threshold of the analytical method).

Table 4 below shows the amount of dimethysiloxane oligomers (in ppm) detected in the original liquid catalytic cracking product (0 minutes) and the samples after the reaction times as mentioned above.

TABLE 4

| | compound (ppm) | | | | | | |
|---|---|---|---|---|---|---|---|
| Time | D3 | L3 | D4 | L4 | D5 | L5 | Sum of the oligomers |
| 0 minutes | 144 | 0 | 351 | 0 | 111 | 0.6 | 606.6 |
| 5 minutes | 27 | 0.6 | 10 | 0 | 52.5 | 0.3 | 90.5 |
| 15 minutes | 0.6 | 0.3 | 0.6 | 0 | 0.8 | 1.5 | 3.8 |
| 30 minutes | 0 | 0.6 | 0 | 0 | 0 | 1.5 | 2.1 |

As this may be seen, Table 4 shows that the treatment has the result of essentially causing disappearance of the dimethylsiloxane oligomers in the mixture after 15 minutes.

D3=hexamethyl cyclotrisiloxane
L3=octamethyl trisiloxane
D4=octamethyl cyclotetrasiloxane
L4=decamethyl tetrasiloxane
D5=decamethyl cyclopentasiloxane
L5=dodecamethyl pentasiloxane.

COMPARATIVE EXAMPLES 1 TO 3

In a 600 ml stirred autoclave, 450 ml of a liquid cracking residue were placed, obtained from the pyrolysis of waste stemming from the recycling of automobile vehicles. More particularly, the liquid cracking residue was a residue initially containing 3,300 ppm of silicon. The tank of the Parr autoclave was equipped with a stirrer, with pressure and temperature probes and an electric heating system. Three distinct tests were conducted according to the parameters shown in Table 5.

TABLE 5

| Comparative example N° | Reagent | Mass concentration of the reagent | Heating T ° (° C.) | Duration of the heating | Efficiency |
|---|---|---|---|---|---|
| 1 | KOH | 5% (15 g) | 150 | 1 h | No |
| 2 | KOH | 5% (10 g) | 225 | 1 h | Yes, <10 ppm of silicon |
| 3 | $Ca(OH)_2$ | 5% (15 g) | 225 | 1 h | No |

Following the heating, the autoclave was left to cool down and after ventilation, the contents of the tank of the autoclave were transferred to a glass distillation apparatus and the latter was distilled under reduced pressure of 15 mm Hg, until the head of the column attains 200° C.

A sample of the obtained distillate was taken and subject to elementary analysis in order to detect the presence of silicon (by ICP) (ion exchange chromatography after mineralization).

These tests were able to show that KOH (at 5% by weight) does not allow a decrease in the silicon concentration in the sample during heating to 150° C. On the other hand, during heating to 225° C. (example according to the invention), KOH (at 5% by weight) strongly reduces the silicon concentration in the sample down to less than 10 ppm. As this may also be seen, during heating to 25° C., the base $Ca(OH)_2$ (at 5% by weight) does not allow a decrease in the silicon concentration of the sample.

These tests therefore show the importance of the heating temperature as well as the importance of the selection of the base for attaining a decrease in the silicon concentration of the sample.

It is well understood that the present invention is by no means limited to the embodiments described above and that many modifications may be provided thereto without departing from the scope of the appended claims.

The invention claimed is:

1. A method for removing derivatives based on siloxane from at least one liquid organic phase, comprising the following steps:

heating of said liquid organic phase to a predetermined temperature, adding a base to said heated organic phase in order to obtain a reaction mixture, mineralizing compounds based on siloxane in said heated organic phase, and liquid/solid separation of said reaction mixture in order to separate said mineralised solid compounds based on siloxane from said liquid organic phase depleted in siloxanes, characterized in that said base is in the form of an alkaline hydroxide and in that the heating step is carried out at said predetermined temperature which is greater than 165° C.

2. The method according to claim 1, wherein, after said addition of the base, the reaction mixture is left to react for a predetermined period of time at said predetermined temperature.

3. The method according to claim 2, wherein said reaction mixture is stirred for at least a portion of said predetermined time.

4. The method according to claim 2, wherein said predetermined period of time is between 1 and 250 minutes.

5. The method according to claim 4, wherein said predetermined time is between 1 and 45 minutes.

6. The method according to claim 1, wherein said predetermined temperature is between 200 and 350° C.

7. The method according to claim 1, wherein said added base in the form of an alkaline hydroxide is selected from KOH and NaOH.

8. The method according to claim 1, further comprising, prior to said mineralization of the compounds based on siloxane, a separation of phenol derivatives and of acids.

9. The method according to claim 8, wherein said acids comprise carboxylic acids.

10. The method according to claim 1, wherein said liquid/solid separation is a distillation.

11. The method according to claim 10, wherein said distillation is carried out under reduced pressure, until the column head fraction attains a temperature of at least 200° C.

12. The method according to claim 1, further comprising, after said mineralization step, a filtration step for carrying out said liquid/solid separation.

13. The method according to claim 1, wherein said organic phase is a catalytic cracking residue of solid waste based on plastic materials.

14. The method according to claim 1 further comprising, before or simultaneously with said heating step, a step for bubbling a gas containing siloxane derivatives from catalytic cracking in a diesel fuel or in an absorbing liquid organic phase in order to obtain said liquid organic phase containing derivatives based on siloxane.

* * * * *